US007908899B2

(12) United States Patent
Bulle

(10) Patent No.: US 7,908,899 B2
(45) Date of Patent: Mar. 22, 2011

(54) SLIDE LOCK

(76) Inventor: Marshall R. Bulle, Rye, CO (US)

( * ) Notice: Subject to any disclaimer, the term of this patent is extended or adjusted under 35 U.S.C. 154(b) by 502 days.

(21) Appl. No.: 12/033,661

(22) Filed: Feb. 19, 2008

(65) Prior Publication Data

US 2008/0209973 A1 Sep. 4, 2008

Related U.S. Application Data

(63) Continuation-in-part of application No. 11/671,543, filed on Feb. 6, 2007, now Pat. No. 7,536,890.

(51) Int. Cl.
*B21D 11/00* (2006.01)

(52) U.S. Cl. ..... 72/306; 72/319; 72/388

(58) Field of Classification Search ..... 72/31.04, 72/31.05, 217, 219, 306, 311, 318, 388, 459
See application file for complete search history.

(56) References Cited

U.S. PATENT DOCUMENTS 5,626,045 A * 5/1997 Bulle ..... 72/219

* cited by examiner

*Primary Examiner* — Dana Ross
*Assistant Examiner* — Teresa M Ekiert
(74) *Attorney, Agent, or Firm* — Nawrocki, Rooney & Sivertson, P.A.

(57) ABSTRACT

Improved slide lock apparatus used in bending apparatus to bend stock to an acute angle. A hydraulic cylinder with a ram extendable under hydraulic pressure provides the bending power. The ram automatically retracts a slide from an first outward location when hydraulic pressure is removed to a second inward location for two separate bends to achieve an acute angle bend. This improved slide lock prevents any possible injury to the operator by covering a stop arranged to prevent the slide from moving outward a greater distance then the first outward location.

5 Claims, 5 Drawing Sheets

SLIDE LOCK

This is a continuation-in-part of application Ser. No. 11/671,543 filed Feb. 6, 2007 now U.S. Pat. No. 7,536,890, hereby incorporated by reference.

FIELD OF THE INVENTION

This invention relates to an improved slide lock for apparatus which bends metal stock on the arc of a circle up to an acute angle of one hundred and eighty degrees by relocating the location of a slide to provide two locations relative to the die.

BACKGROUND OF THE INVENTION

A large force is required to bend stock to an acute angle of one hundred and eighty degrees. Bending apparatus which requires such a large force uses a hydraulic cylinder with an extending ram. An extension of the ram transmits the force to apparatus which bears against the stock and bends it. An acute angle bend presents a problem compared to smaller bends because the force required is large and must be exerted over a long distance. This is difficult to achieve with a cylinder and ram because the long distance requires a long cylinder and ram which are both prone to buckling under such a large force.

While a variety of metal stock benders are known in the art, the ability to bend stock to an acute 180 degree angle has only been provided by Mann et al. U.S. Pat. No. 2,656,872. Mann et al. utilizes a swinging frame which changes the angle and distance of the frame with respect to a forming die. This permits making a large bend by making smaller bends at each location. This apparatus is fairly complex and requires a substantial amount of shop space because of the size of the frame and the size of the arc.

SUMMARY OF THE INVENTION

This invention is an improvement to the slide lock arrangement used in the parent case to secure the slide at two locations relative to the item being bent. This arrangement permits bending an acute angle in two steps with the force exerted on the bending arm being exerted first from an outer and then an inner location but with no intermediate set-up of the apparatus required.

This process was accomplished in the parent application by a slide lock which used a pivotably mounted spring loaded clapper arranged to urge a gudgeon through an aligned hole in the slide against the slide bar. The slide bar had a hole sized and arranged to receive the gudgeon. The slide bar hole was aligned with the gudgeon when the slide was at a predetermined location inward from the stop. This permitted urging the gudgeon through the aligned hole and automatically locked the slide to the slide bar at that location. The clapper had a handle arranged to permit rotating the clapper and remove the gudgeon from the hole in the slide bar to manually unlock the slide from the slide bar. That arrangement provided an outer first and an inner second location for the cylinder and ram relative to the die. Since the full force of the cylinder could be exerted on the stop there was the potential for injury if the operator happened to have his hand or fingers in that area.

This improvement to the parent application eliminates a potential danger to the operator in that a ramp along the slide bar extends upward from the outer to a point adjacent to the inner location. The outer end of the ramp provided a stop which engaged a gudgeon which extending downward from the slide. At the outer location the stop is covered by the slide and not accessible to the operator. Further, since the slide is moved manually from the inner to the outer position there is no possibility of injury. A hole adjacent to the opposite upper end of the ramp is sized to receive the gudgeon to automatically lock the slide at the inner location. Since the slide is drawn from the outer to the inner location by a spring, which retracts the cylinder extension for the second bend, there is no large force exerted between the gudgeon the hole which could injure the operator. This arrangement eliminates a possible hazard of the previous arrangement for securing the slide at the outer and inner locations.

DETAILED DESCRIPTION OF THE INVENTION

Figure 1:
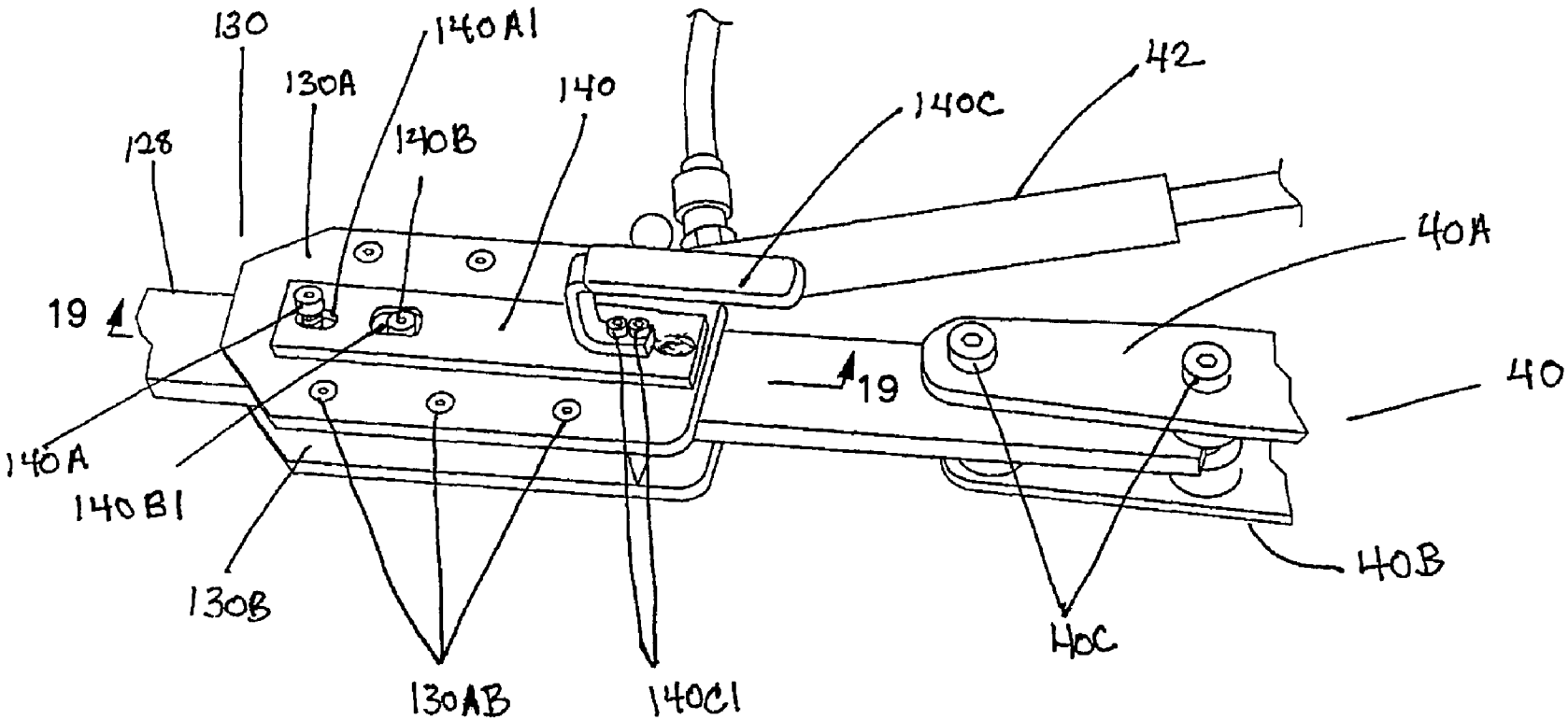
FIG. 1 shows a top view of one version of the improved slide lock arrangement attached to the bender apparatus.

FIGS. 1-5 illustrate a first embodiment of the improved slide lock. FIG. 1 shows slide 130 consisting of an upper side plate 130A and a lower side plate 130B slideably secured to each other on opposite sides of slide bar 128 by three bolts 130AB extending through mating holes in the upper side plate and secured in mating threaded holes in the lower side plate. Arm 40 extending from the bending apparatus has an upper arm portion 40A opposite lower arm portion 40B which are connected together through spacers on opposite sides of slide bar 128 by bolts 40C extending through mating holes in upper arm 40A and secured in mating threaded holes in lower arm 40B.

Clapper 140 is pivotably mounted to the end of upper slide plate 130A opposite arm 40 by bolt 140A which extends through a coiled spring 140A2 into hole 140A1 which is sized large enough to enclose the spring and permit the clapper to incline with respect to upper slide plate 130A which assists in rotating the end of clapper adjacent to arm 40 towards the upper slide plate 130A. Bolt 140B has its head recessed in slot 140B1 extending along clapper 140 terminating in a mating threaded hole in upper side plate 130A to align clapper 140 with slide 130. This arrangement is essentially identical in operation to that used with the first slide lock arrangement for pivoting clapper 140 except for the change in the end pivoted. A clapper handle 140C is mounted on the end of clapper 140 by bolts 140C1 through mating holes in the handle secured in mating threaded holes in the clapper. In this improved slide lock arrangement, lifting the end of handle 140C is used to rotate clapper 140 from a first angle parallel to upper slide plate 130A to a second angle relative to the upper slide plate. The size of the second angle is described later.

Figure 2:
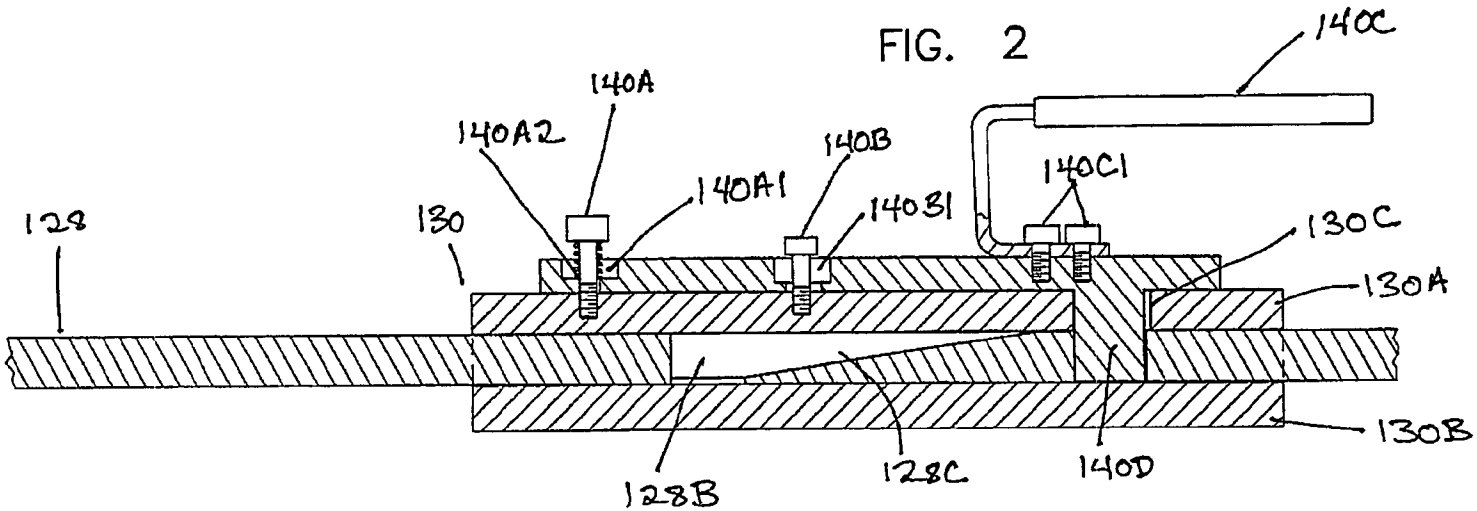
FIG. 2 shows the cross-section of the slide lock arrangement of FIG. 1 with the slide positioned with respect to the slide bar locating the gudgeon within the hole in the slide bar.

FIG. 2 shows clapper 140 parallel to upper slide plate 130A with a gudgeon 140D extending outward from the clapper through hole 130C in upper slide plate 130A and hole 128A in slide bar 128 to the inner surface of lower slide plate 130B. Slide bar 128 has a channel 128B with an opening extending inward from the face of slide bar 128 opposite to clapper 140, the opening being rectangular and the major dimension extending along the slide bar length. Channel 128B has vertical sides extending inward toward the inner face of lower slide plate 130B. The channel having a width along the length of slide bar 128 adequate to admit gudgeon 140D. Channel 128B has a planar surface facing the opening which forms planar ramp 128C extending from the end closest to arm 40 which extends inwardly linearly from the surface of slide bar 128 adjacent to upper slide bar 130A to a maximum depth near the surface of lower slide plate 130B at a point offset an amount from the vertical end of the channel opposite to arm 40 to admit the end of gudgeon 140D. As shown here slide 130 is at the second inner location with respect to arm 40 with slide 130 locked to slide bar 128 by gudgeon 140D extending through holes 130C and 128A. This is the location of slide 130 relative to slide bar 128 when the second bend is made.

Figure 3:
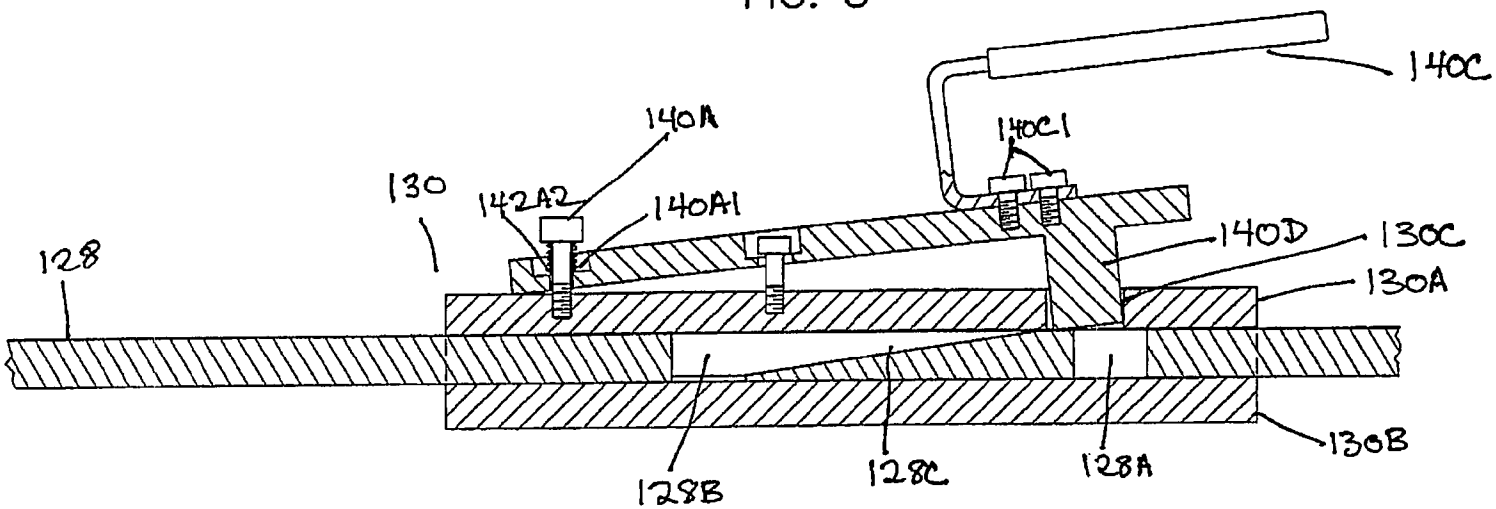
FIG. 3 shows the cross-section of the slide lock arrangement of FIG. 1 with the slide positioned with respect to the slide bar locating the gudgeon at the upper edge of the ramp at the surface of the slide bar facing the slide.

FIG. 3 shows clapper 140 and gudgeon 140D after being moved from the location shown in FIG. 2 by manually lifting clapper 140 upward using handle 140C to rotate the clapper from the first to the second angle with respect to upper slide plate 130A. This lifts the inner end of gudgeon 140D outward from hole 128A in slide bar 128 and releases slide 130 from slide bar 128. Handle 140C is then used to manually translate slide 130 to the location shown in FIG. 3.

Figure 4:
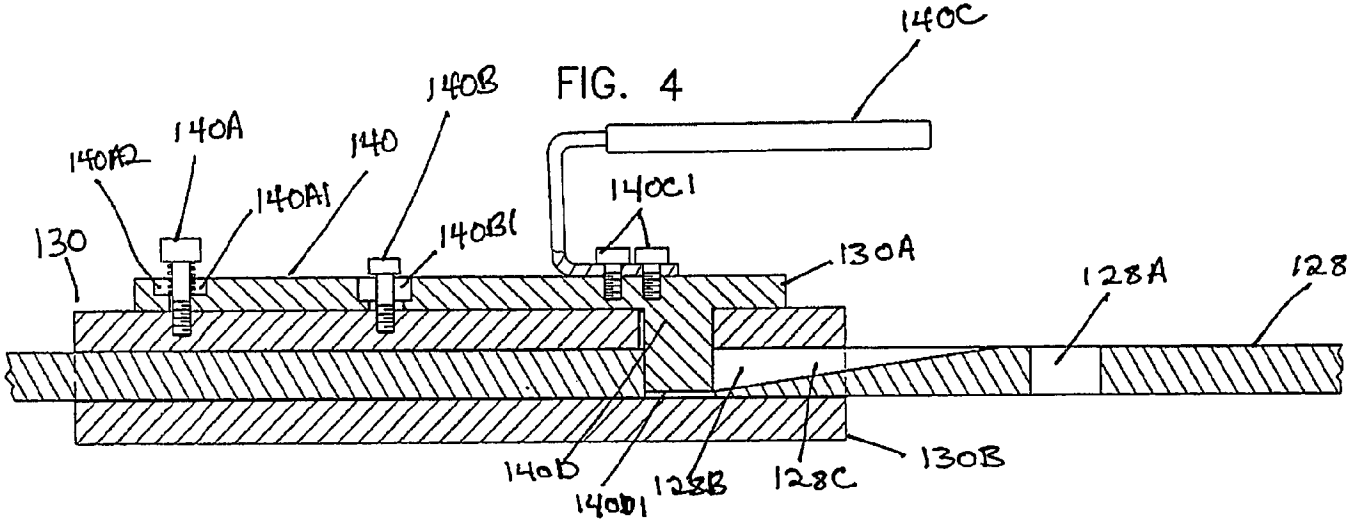
FIG. 4 shows the cross-section arrangement of FIG. 1 with the slide positioned with respect to the slide bar locating the gudgeon between the innermost end of the ramp and the end of the channel opposite to the bending apparatus.

FIG. 4 shows slide 130 after being moved manually by handle 140C along slide bar 128 from the location shown in FIG. 3 to the outer first location relative to arm 40. Here the full length of gudgeon 140D bears against the vertical end wall of channel 128 opposite to arm 40. This provides at sturdy stop at this first location of slide 130 relative to slide bar 128 and prevents the slide from moving a greater distance from arm 40. This first location is the location of slide 150 when the first bend is made.

Figure 5:
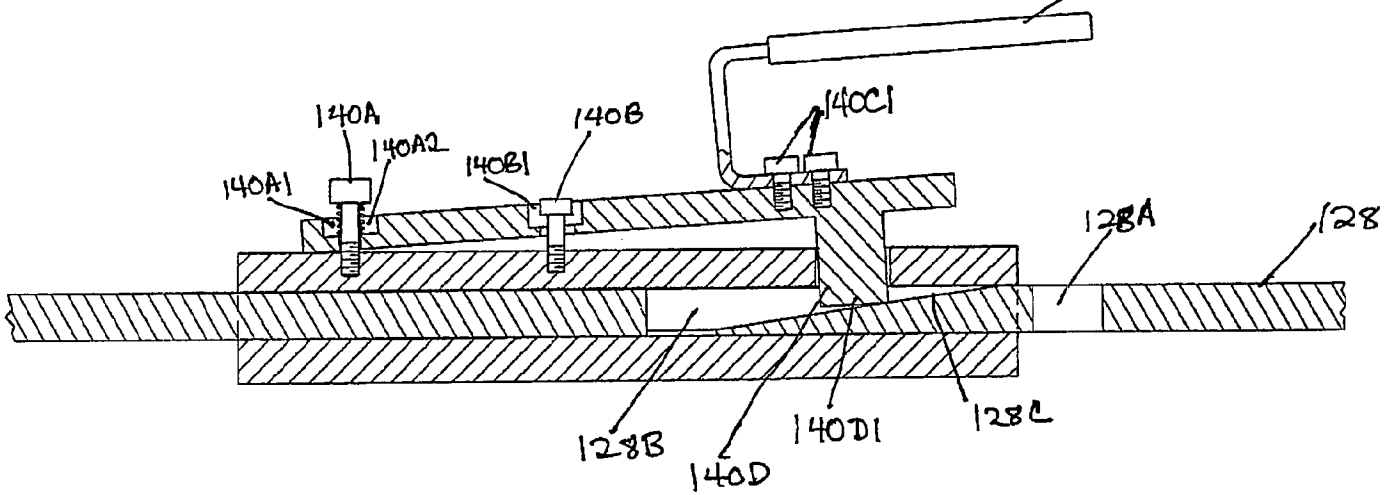
FIG. 5 shows the cross-section arrangement of FIG. 1 with the slide positioned with respect to the slide bar locating the gudgeon midway on the ramp using the second embodiment of the slide lock.
Figure 6:
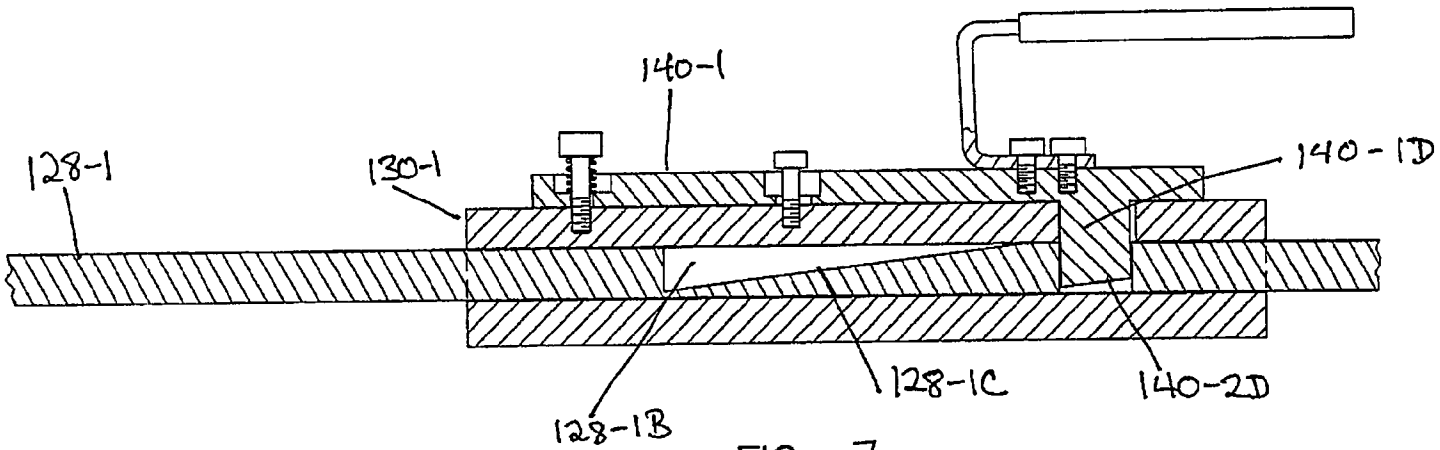
FIG. 6 shows the cross-section arrangement of the second embodiment of the slide lock with the slide positioned the same as FIG. 2 with respect to the slide bar.
Figure 7:
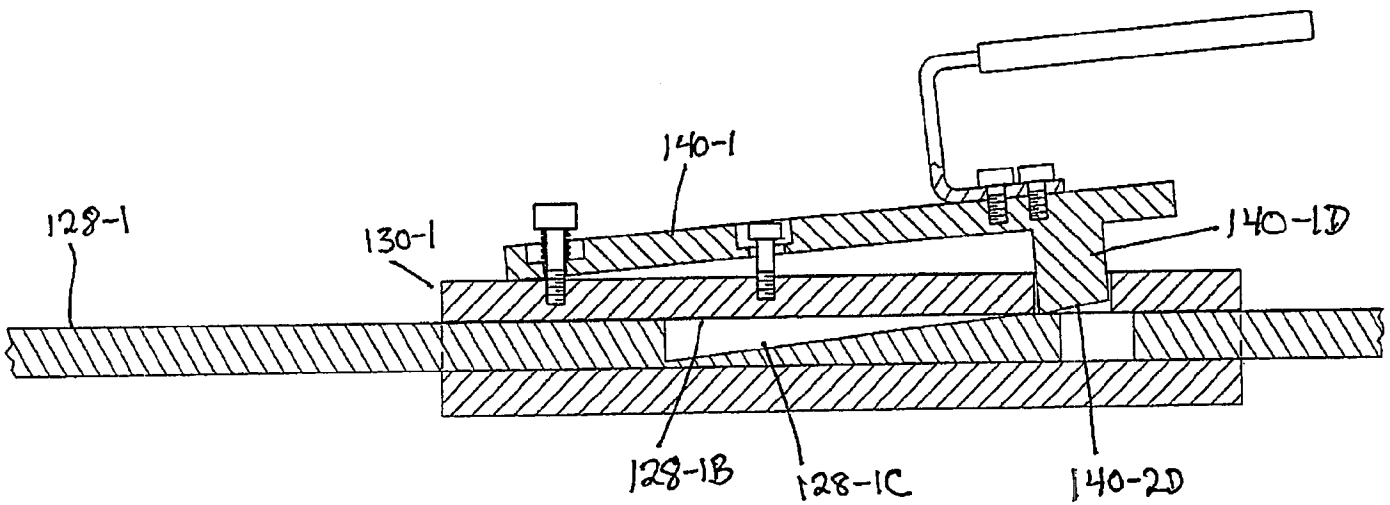
FIG. 7 shows the cross-section arrangement of the second embodiment of the slide lock with the slide positioned the same as FIG. 3 with respect to the slide bar.
Figure 8:
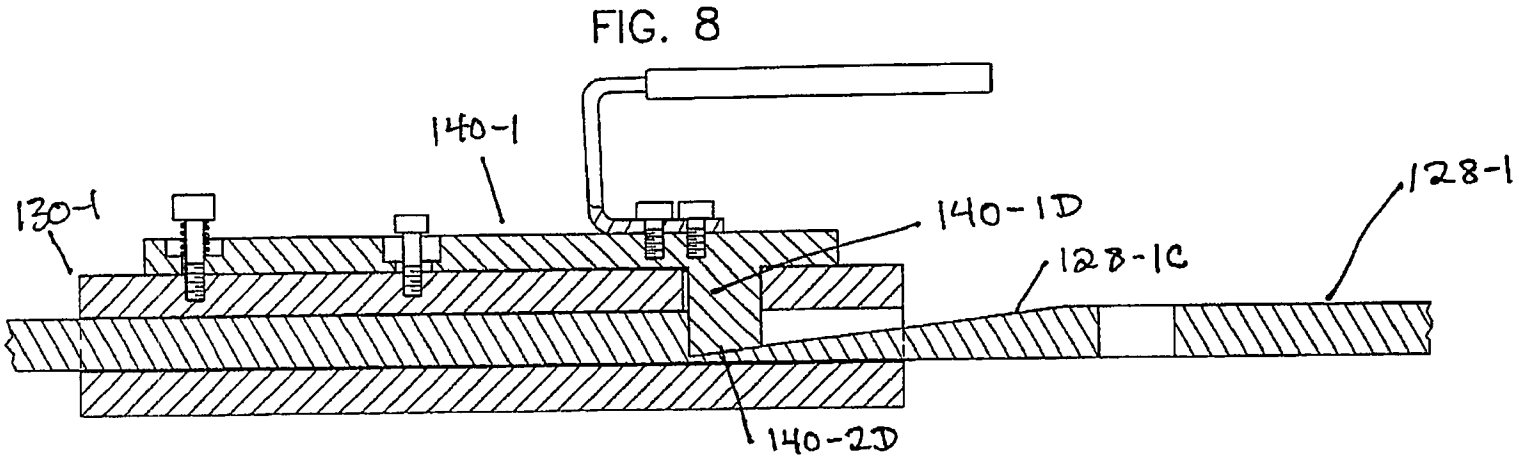
FIG. 8 shows the cross-section arrangement of the second embodiment of the slide lock with the slide positioned the same as FIG. 4 with respect to the slide bar.
Figure 9:
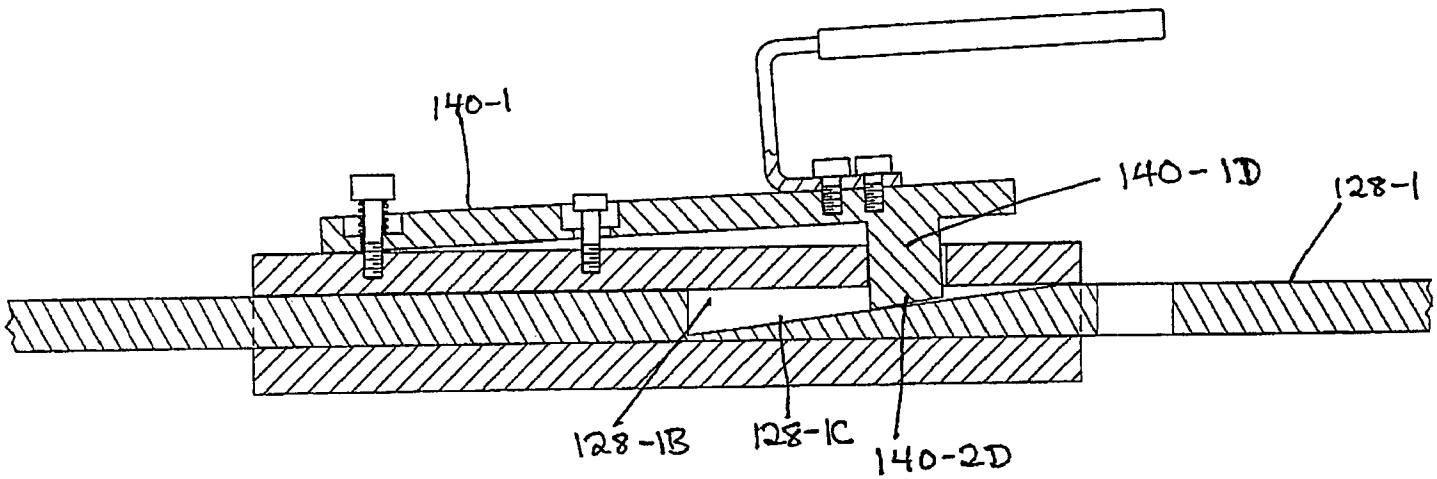
FIG. 9 shows the cross-section arrangement of the second embodiment of the slide lock with the slide positioned the same as FIG. 4 with respect to the slide bar.

FIG. 5 shows gudgeon 140D midway on ramp 128C from the location shown in FIG. 4. This results after the first bend has been made and pressure is removed from cylinder 42 allowing its ram to retract. As described for the previous slide lock arrangement, the retraction of the ram of cylinder 42 will pull slide 130 from position one toward position two which here has positioned gudgeon 140D midway on ramp 128C and rotated clapper 140 between the first and the second angle. When the ram of cylinder 42 is fully retracted slide 130 will be at the position shown in FIG. 2 with gudgeon 140D locking slide 130 to slide bar 128 as described earlier. When slide 130 is locked to slide bar 128 the bending apparatus is arranged to make the second bend as described earlier.

FIGS. 6-9 show clapper 140-1, gudgeon 140-1D with an end 140-2D, a slide 130-1, slide bar 128-1, slide bar channel 128-1B with a ramp 128-1C. These figures show a second embodiment of the improved slide lock the following changes: ramp 128-1C extends completely across slide bar 128-1 channel 128-1B to the end opposite to arm 40 rather than terminating a distance offset therefrom and gudgeon 140-1D has an end 140-2D with an incline which matches the incline of ramp 128-1C. With these arrangement the side of gudgeon 140-1D again bears against the entire vertical end wall of channel 128-1B opposite to arm 40 even through the ramp is changed in shape. This also provides at sturdy stop at this first location of slide 130-1 relative to slide bar 128-1. The operation of the first and second embodiments of the two slide locks are identical and the discussions of: FIG. 2 applies to FIG. 6, FIG. 3 applies to FIG. 7, FIG. 4 applies to FIG. 8 and FIG. 5 applies to FIG. 9.

The previous slide lock arrangement was accomplished by the end of the slide itself bearing against a barrier. This previous arrangement presented a danger in that this area was exposed and the operator could place a hand or finger between these two parts. Since a large outward force is applied against the stop during the first bend this could result in serious injury. In this improved slide lock arrangement the stop is located under slide 130 which is not accessible to the operator and eliminates this danger.

There are undoubtedly a number of other arrangements which will rotate clapper 140 from the first to the second angle as slide 130 translates from the first to the second location, as illustrated by the two embodiments described here. It will be understood therefore that this disclosure, in many respects, is only illustrative. Changes may be made in details, shape, size, material, and arrangement of parts can also be made without exceeding the scope of the invention. Accordingly, the scope of the invention is as defined in the language of the appended claims.

What is claimed is:

1. Locking apparatus for restraining the movement of a slide at a plurality of locations relative to bending apparatus, the apparatus comprising:

a) a slide, slide bar and bending apparatus, the slide bar being attached to the bending apparatus extending outwardly therefrom, with the slide having means for slideably attaching the slide to the slide bar arranged to translate between a first location distant from the bending apparatus to a second location closer thereto;

b) a clapper having pivotable means for pivotably attaching the clapper to an outer surface of the slide arranged to pivot around the end of the clapper opposite to the bending apparatus, and further having means for urging the clapper from a second angle inclined with respect to the slide to a first angle where the clapper and slide are parallel;

c) a gudgeon perpendicularly attached to the surface of the clapper facing the slide;

d) the slide having a hole sized, oriented and located to admit the gudgeon;

e) the slide bar having a hole sized, oriented and located to receive the gudgeon when the clapper is at the first angle with the gudgeon having a length adequate to extend into the hole through the slide when the clapper is at the first angle but not the second angle, and the gudgeon length being adequate to extend into the hole through the slide bar when the clapper is at the first angle and the slide is at the second location; and f) the slide bar having means for changing the angle of the clapper relative to the slide between the second angle and the first angle as the slide moves between the first and the second location, and the slide bar further having means for blocking movement of the slider outward from bending apparatus at the first location;

g) wherein the means for changing the angle of the clapper comprises the surface of the slide bar facing the gudgeon having a channel extending from the first location to an intermediate location between the first and second location, with the inner surface of the channel opposite to the opening forming a planar ramp extending from a maximum depth at the second location to the surface of the slide bar at the intermediate location between the first and the second location, with the ramp and gudgeon being dimensioned to result in the clapper being at the first angle with respect to the slide when the slide is at the first location and at the second angle when the slide is at the first intermediate location, and wherein the means for blocking movement of the slide outward from bending apparatus at the first location having a vertical surface at the end of the channel opposite to the bending apparatus; having a hole into the surface facing the gudgeon sized to accept the gudgeon at the second location, with the gudgeon having a length adequate to extend through the hole in the slide into the hole in the slide bar, with the end of the channel opposite to the bending apparatus being perpendicular to the opening blocking movement of the slide relative to the bending apparatus outward from the first location.

2. Apparatus as in claim 1 wherein the ramp terminates a distance from the end opposite the bending apparatus adequate to accept the end of the gudgeon.

3. Apparatus as in claim 2 wherein the ramp terminates at the end of the channel opposite to the bending apparatus with the end of the gudgeon facing the ramp having a matching inclination.

4. Locking apparatus for restraining the movement of a slide at a plurality of locations relative to bending apparatus, the apparatus comprising:

a) a slide, slide bar and bending apparatus, the slide bar being attached to the bending apparatus extending outwardly therefrom, with the slide having means for slideably attaching the slide to the slide bar arranged to translate between a first location distant from the bending apparatus to a second location closer thereto;

b) a clapper having pivotable means for pivotably attaching the clapper to an outer surface of the slide arranged to pivot around the end of the clapper opposite to the bending apparatus, and further having means for urging the clapper from a second angle inclined with respect to the slide to a first angle where the clapper and slide are parallel;

c) a gudgeon perpendicularly attached to the surface of the clapper facing the slide;

d) the slide having a hole sized, oriented and located to admit the gudgeon;

e) the slide bar having a hole sized, oriented and located to receive the gudgeon when the clapper is at the first angle with the gudgeon having a length adequate to extend into the hole through the slide when the clapper is at the first angle but not the second angle, and the gudgeon length being adequate to extend into the hole through the slide bar when the clapper is at the first angle and the slide is at the second location; and f) the slide bar having means for changing the angle of the clapper relative to the slide between the second angle and the first angle as the slide moves between the first and the second location, and the slide bar further having means for blocking movement of the slider outward from bending apparatus at the first location;

g) whereby the means for urging the clapper from the second to the first angle comprises a spring arranged to force the end of the clapper opposite to the gudgeon outward from the slide.

5. Locking apparatus for restraining the movement of a slide at a plurality of locations relative to bending apparatus, the apparatus comprising:

a) a slide, slide bar and bending apparatus, the slide bar being attached to the bending apparatus extending outwardly therefrom, with the slide having means for slideably attaching the slide to the slide bar arranged to translate between a first location distant from the bending apparatus to a second location closer thereto;

b) a clapper having pivotable means for pivotably attaching the clapper to an outer surface of the slide arranged to pivot around the end of the clapper opposite to the bending apparatus, and further having means for urging the clapper from a second angle inclined with respect to the slide to a first angle where the clapper and slide are parallel;

c) a gudgeon perpendicularly attached to the surface of the clapper facing the slide;

d) the slide having a hole sized, oriented and located to admit the gudgeon;

e) the slide bar having a hole sized, oriented and located to receive the gudgeon when the clapper is at the first angle with the gudgeon having a length adequate to extend into the hole through the slide when the clapper is at the first angle but not the second angle, and the gudgeon length being adequate to extend into the hole through the slide bar when the clapper is at the first angle and the slide is at the second location; and f) the slide bar having means for changing the angle of the clapper relative to the slide between the second angle and the first angle as the slide moves between the first and the second location, and the slide bar further having means for blocking movement of the slider outward from bending apparatus at the first location;

g) whereby the means for urging the clapper from the second to the first angle comprises the weight of the gudgeon.

* * * * *

UNITED STATES PATENT AND TRADEMARK OFFICE

CERTIFICATE OF CORRECTION

PATENT NO. : 7,908,899 B2
APPLICATION NO. : 12/033661
DATED : March 22, 2011
INVENTOR(S) : Marshall R. Bulle It is certified that error appears in the above-identified patent and that said Letters Patent is hereby corrected as shown below:

IN THE CLAIMS:

Col. 5, line 30 thereof, the numeral “2” should read --1--, so that claim 3 depends from claim 1.

Signed and Sealed this
Seventeenth Day of May, 2011

David J. Kappos

David J. Kappos
*Director of the United States Patent and Trademark Office*